US006315930B1

(12) United States Patent
Hamilton

(10) Patent No.: US 6,315,930 B1
(45) Date of Patent: Nov. 13, 2001

(54) METHOD FOR MAKING A PROPELLANT HAVING A RELATIVELY LOW BURN RATE EXPONENT AND HIGH GAS YIELD FOR USE IN A VEHICLE INFLATOR

(75) Inventor: Brian K. Hamilton, Littleton, CO (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 09/406,023

(22) Filed: Sep. 24, 1999

(51) Int. Cl.[7] ..... C06B 21/00; C06B 41/10; C06B 41/06

(52) U.S. Cl. ..... 264/3.1; 264/3.2; 264/3.3; 149/19.7; 149/46; 149/60

(58) Field of Search ..... 214/3.1, 3.2, 3.3; 149/19.7, 46, 60

(56) References Cited

U.S. PATENT DOCUMENTS

| | | | | |
|---|---|---|---|---|
| 3,173,817 | | 3/1965 | Wright | 149/2 |
| 3,959,044 | * | 5/1976 | Young | 149/41 |
| 4,102,953 | | 7/1978 | Johnson et al. | 264/3 B |
| 4,140,561 | | 2/1979 | Keith et al. | 149/2 |
| 4,381,958 | | 5/1983 | Howard | 149/19.8 |
| 4,428,786 | | 1/1984 | Arni | 149/21 |
| 4,435,232 | | 3/1984 | Ciaramitaro et al. | 149/2 |
| 4,455,914 | * | 6/1984 | Christmann et al. | 86/1 R |
| 4,525,313 | | 6/1985 | Müller | 264/3 B |
| 4,585,600 | | 4/1986 | Rollyson et al. | 264/3.3 |
| 4,867,920 | * | 9/1989 | Sudweeks et al. | 264/3.1 |
| 4,878,922 | * | 11/1989 | Kaye | 44/502 |
| 4,931,229 | | 6/1990 | Krimmel et al. | 264/3.3 |
| 5,114,630 | | 5/1992 | Newman et al. | 264/3.1 |
| 5,125,684 | * | 6/1992 | Cartwright | 280/736 |
| 5,266,242 | | 11/1993 | Mogendorf et al. | 264/3.3 |
| 5,403,035 | | 4/1995 | Hamilton | 280/736 |
| 5,487,851 | | 1/1996 | Dillehay et al. | 264/3.3 |
| 5,545,272 | | 8/1996 | Poole et al. | 149/48 |
| 5,583,315 | | 12/1996 | Fleming | 149/19.4 |
| 5,596,168 | * | 1/1997 | Menke et al. | 149/19.4 |
| 5,641,938 | | 6/1997 | Holland et al. | 149/48 |
| 5,726,382 | | 3/1998 | Scheffee et al. | 149/19.91 |
| 5,747,730 | | 5/1998 | Scheffee et al. | 149/47 |
| 5,780,768 | | 7/1998 | Knowlton et al. | 149/36 |
| 5,831,339 | * | 11/1998 | Lefumeux et al. | 264/3.3 |
| 5,866,842 | | 2/1999 | Wilson et al. | 149/19.6 |
| 5,868,424 | | 2/1999 | Hamilton et al. | 280/741 |
| 5,872,329 | | 2/1999 | Burns et al. | 149/36 |
| 6,120,626 | * | 9/2000 | Hamilton | 149/2 |
| 6,231,702 | * | 5/2001 | Blomquist | 149/36 |

* cited by examiner

*Primary Examiner*—Jan H. Silbaugh
*Assistant Examiner*—Michael I. Poe
(74) *Attorney, Agent, or Firm*—Sheridan Ross P.C.

(57) ABSTRACT

A method for making a propellant composition that results in a desirable gas output when combusted. The propellant can be part of an inflator used in a vehicle for inflating an air bag. The propellant has a relatively low burn rate exponent of no greater than about 0.7. The propellant is substantially dense, with the propellant having a density that is at least 85% of theoretical density. In making the propellant, its density can be reduced using a roller mill that flattens the propellant to a controlled thickness. The propellant preferably includes phase-stabilized ammonium nitrate and fibrous cellulose.

21 Claims, 1 Drawing Sheet

FIGURE
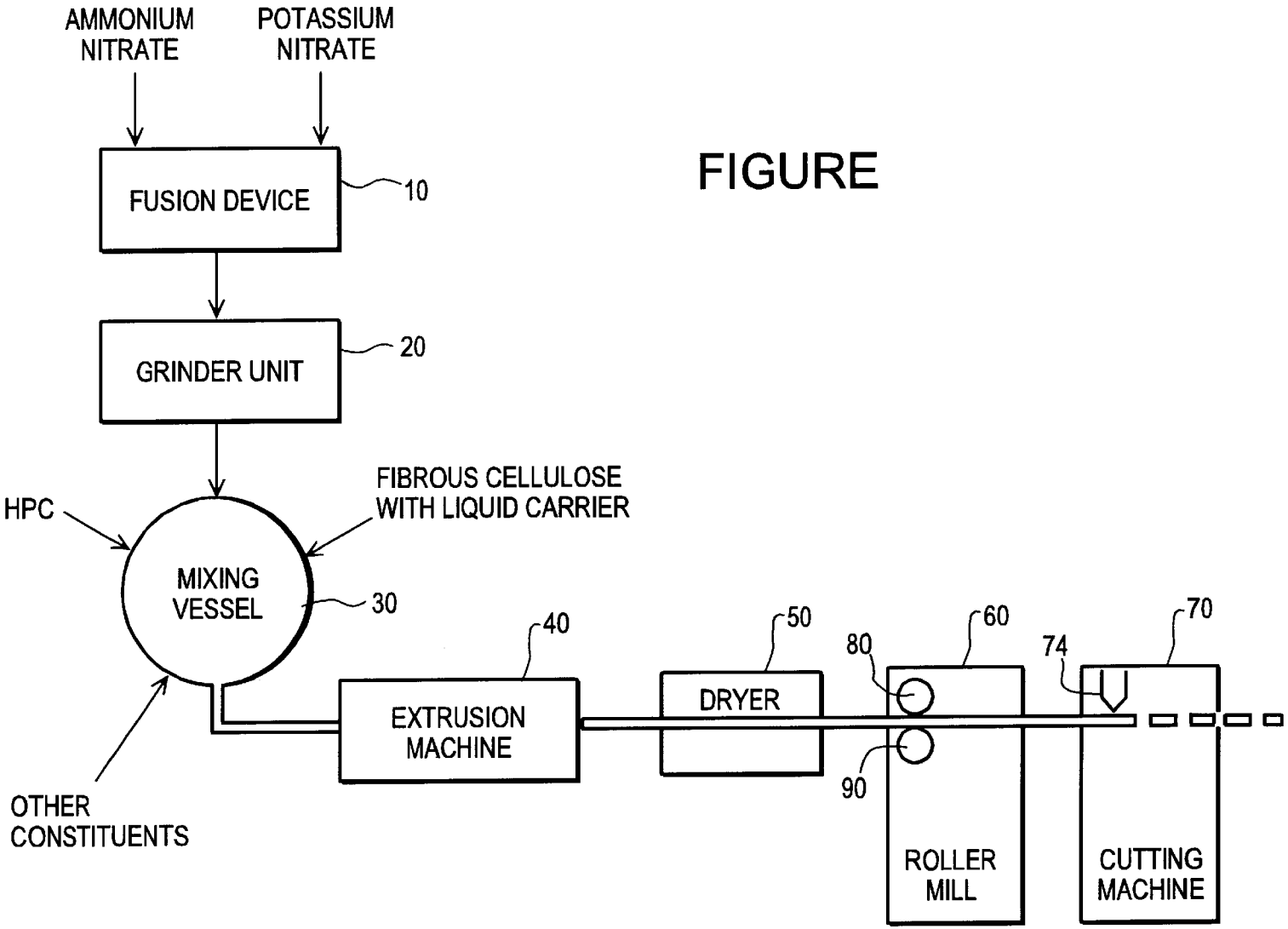

METHOD FOR MAKING A PROPELLANT HAVING A RELATIVELY LOW BURN RATE EXPONENT AND HIGH GAS YIELD FOR USE IN A VEHICLE INFLATOR

The present invention relates to application Ser. No. 09/177,881 filed Oct. 23, 1998 and entitled "Propellant For Pyrotechnic Inflator Used in a Vehicle."

FIELD OF THE INVENTION

The present invention relates to a propellant composition, particularly a propellant composition having a low burn rate exponent related to burning stability.

BACKGROUND OF THE INVENTION

Propellants have numerous and widespread applications including in vehicles with air bag modules. Among other parameters, propellants can be characterized based on their stability when burning in an air bag inflator. Preferred stability relates to a constant and/or uniform burning of the propellant, along its length, from its outer surface inwardly to its center. A quantitative representation related to propellant combustion stability is in the form of a burn rate exponent n, which is a material parameter defined by $[\ln(R_2/R_1)]/[\ln(P_2/P_1)]$, where $R_2$ is burn rate at pressure $P_2$ and $R_1$ is a burn rate at pressure $P_1$, (not equal to $P_2$). The burn rate exponent of most propellants has a value between zero and one. The closer the burn rate exponent value is to one the greater is the instability of the inflator. The operating pressure of the inflator is related to the propellant and inflator hardware properties through the relation:

$$P = C\left(\frac{A_b}{A_c}\right)^{\frac{1}{1-n}}$$

P=instantaneous operating pressure of the inflator.

C=constant $A_b$=instantaneous burning surface area of the propellant.

$A_c$=outlet orifice area of the inflator.

It is well known that it is difficult to achieve adequate stability of inflators using propellants with burn rate exponents above about 0.7. Conversely, desired burning stability of the inflator is present when the burn rate exponent of the propellant is no greater than about 0.7.

Certain materials are known to have low and desirable burn rate exponents. Ammonium nitrate based propellants typically have a burn rate exponent of about 0.5. Consequently, ammonium nitrate has a desirable high stability during its combustion. However, ammonium nitrate suffers from certain drawbacks as part of a propellant composition. Especially in comparison with other useful propellant compositions, ammonium nitrate propellants are typically difficult to ignite and have a low burning rate once ignited. It is known to combine ammonium nitrate with another material, such as a secondary explosive, to enhance or achieve the necessary burning rate and/or ease of ignition. Such known propellant compositions have also increased the burn rate exponent of the resulting propellant composition to a burn rate exponent value of greater than 0.7.

It would be beneficial to provide a propellant composition, for use in vehicle inflators or other applications, that includes ammonium nitrate so that the propellant is stable during its burning, while achieving a necessary or desirable propellent burning rate and ignition thereof.

SUMMARY OF THE INVENTION

In accordance with the present invention, a propellant is provided that has a relatively low burn rate exponent.

Preferably, the burn rate exponent is no greater than 0.7. As the value of the burn rate exponent increases above 0.7, the operation of the gas generator becomes increasingly unstable and impractical. Conversely, a propellant having a burn rate exponent of about 0.7 and less is desirably stable, particularly when used with an inflator to inflate an air bag or other inflatable in a vehicle. Stability refers to a propellant property by which there is a predictable and uniform output of inflator gas from the inflator. In one embodiment, the propellant composition includes phase-stabilized ammonium nitrate (PSAN). The phase-stabilized ammonium nitrate constitutes at least a majority, by weight, and preferably a substantial majority, of the propellant composition. The PSAN has the property that, after being subject to temperature cycling in the range of −40° C. through 90° C. through a substantial number of cycles of arbitrary shape and duration, the propellant composition having the PSAN is functional in an inflator. In one embodiment, in addition to the ammonium nitrate, the PSAN includes potassium nitrate in the range, by weight, of about 8%–14%, or any other one or more phase-stabilizing components could be utilized in addition to, or as a substitute for, the potassium nitrate.

In the preferred embodiment, in connection with achieving the desired relatively lower burn rate exponent, the propellant composition also includes fibrous cellulose, such as available from pulp board or wood pulp. The fibrous cellulose is different from non-fibrous cellulosic material such as nitrate cellulose, cellulose acetate, and cellulose acetate butyrate. The fibrous cellulose is useful in achieving a lower burn rate exponent, instead of a secondary explosive, inasmuch as the secondary explosive with the PSAN typically increases the burn rate exponent of the propellant composition to a much greater value. Consequently, it is most preferred that there be no secondary explosive, or substantially none, in the propellant composition. However, some secondary explosive could be included but, in no event, should the amount by weight of secondary explosive be greater than 20% of the propellant composition.

The propellant composition may also include is hydroxypropylcellulose (HPC) or other cellulose ethers or derivatives, which is the soluble part of the binder system of the propellant composition. The fibrous cellulose can also act as a contributor to the binder system. Small amounts of other materials can be included in the propellant composition including stabilizers, plasticizers and a ph control component.

In one embodiment, the burning rate of the propellant is controllable, based on controlling the thickness of the propellant and concomitantly the density of the propellant. That is to say, as a finished product, the propellant is at least 85% of theoretical density. With such density, the number and sizes of pores are reduced so that the porosity of the propellant is limited. Accordingly, the burning or combustion of the propellant from its outer surface inwardly towards its center is substantially uniform and constant. In one embodiment, the propellant composition includes PSAN and the fibrous cellulose.

When making the propellant composition, the combination of materials that includes PSAN and fibrous cellulose has a first or lower density after being formed. Later, the density of this composition is increased further to a greater percentage of theoretical density, namely, 85% or greater. In one embodiment, the increase in density (i.e. the reduction in the porosity) of the propellant composition having PSAN and fibrous cellulose is accomplished by essentially flattening the propellant to a ribbon-like structure using appropriate pressing or flattening machinery.

Based on the foregoing summary a number of salient aspects of the present invention are recognized. The propellant composition of the present invention generates a predictable gas output based on a pyrotechnic inflator having greater stability, particularly where the propellant is utilized in an inflator for an air bag. This stability is preferably achieved with a propellant composition that includes phase-stabilized ammonium nitrate and fibrous cellulose. This combination results in a relatively low burn rate exponent, such as no greater than 0.7. Preferably, the greater stability is achievable using a highly densified propellant composition, namely, at least 85% of theoretical density. In one embodiment, the propellant composition has a first density, which is increased to a second density, preferably, using a roller mill or other functionally comparable machinery. Preferably, the fibrous cellulose is utilized to achieve such density. In making the propellant, its thickness can be controlled resulting in a desired burning rate.

Additional advantages of the present invention will become readily apparent from the following discussion, particularly when taken together with the accompanying drawing.

BRIEF DESCRIPTION OF THE DRAWING

The single FIGURE diagrammatically illustrates a process associated with making the propellant of the present invention.

DETAILED DESCRIPTION

The present invention is described in greater detail in the context of the propellant being part of an inflator for use in a vehicle, although such propellant may be suitable for other applications. When the propellant is ignited as part of an inflator, it combusts and generates products of combustion including inflation gases that are used to inflate the air bag or other inflatable.

The propellant composition achieves a number of objectives. These objectives includes generation of a sufficient gas yield for pressurizing the inflatable; a resulting temperature after ignition of the propellant that is within an acceptable range (less than an unacceptable resulting temperature); and the products of combustion after activation of the propellant are stoichiometrically balanced, e.g., no unacceptable amounts of carbon monoxide (CO) are part of such combustion products (i.e., sufficient oxidation should have occurred).

The propellant is part of a pure pyrotechnic inflator in which substantially entirely all gases provided by the inflator are propellant gases generated by the solid gas-generating propellant. Preferably, the propellant has a composition that is substantially free of metals so that the propellant gases are substantially free, or in the absence of, metal-containing particulate and/or condenseable materials, reducing the need for filtration to remove any such particulate and/or condenseable materials. Furthermore, in a preferred embodiment, the propellant is substantially free of halogen-containing materials so that the propellant gases are substantially free, or the absence, of halogen-containing components.

In the preferred embodiment, the propellant composition includes phase-stabilized ammonium nitrate (PSAN). The phase-stabilized ammonium nitrate, when subject to arbitrary temperature cycling or a very substantial number of temperature cycles in the range of about −40° C. through +90° C., is properly, sufficiently, or otherwise suitably functional in an inflator located in a vehicle. The PSAN has a burn rate exponent (n) associated with it, with n being equal to about 0.5–0.6. The burn rate exponent relates to the stability of the particular material or composition. The stability thereof relates to the manner by which the material or composition burns or combusts after ignition. Desired stability is achieved when the subject material or composition burns predictably or constantly from its outer surface where it is ignited inwardly to its center and along the entire length of the subject material or composition, despite small variations in propellant surface area or nozzle area. The burn rate exponent for most propellants has a value between 0–1. The greater the value of the burn rate exponent, particularly as n approaches 1, the greater is the instability associated with the particular material or composition. By way of example, there is increasing instability as the burn rate exponent increases above n=0.7. Conversely, for values of n that decrease from 0.7, there is greater stability, with desired stability for a propellant in an inflator application occurring at n=0.7 and less.

The phase-stabilized ammonium nitrate includes ammonium nitrate and a material or compound that acts as a phase-stabilizing component. The amount of ammonium nitrate in the propellant composition, by weight is at least a majority of the weight of the propellant composition and usually a substantial majority of the weight. The phase-stabilizing component can include one or more materials that provide this function, with potassium nitrate being an exemplary material that provides this function in connection with the phase-stabilizing ammonium nitrate being used as part of the propellant composition in an inflator for use in a vehicle. Instead of potassium nitrate as the phase-stabilizing component or the only phase-stabilizing component, an appropriate amount of zinc amine could be utilized. Relatedly, instead of only potassium nitrate, a small amount (about 0.5%) of amaranth might be included. Other possible materials for phase stabilizing ammonium nitrate and associated patent disclosures are: potassium fluoride (U.S. Pat. No. 5,098,683); magnesium carbonate (U.S. Pat. No. 3,428,418); copper/nickel amine complexes (U.S. Pat. No. 4,925,600 and U.S. Pat. No. 5,063,036); potassium dinitramide (U.S. Pat. No. 5,292,387); ammonium polyphosphates (U.S. Pat. No. 4,001,377); and cesium nitrate. It is also noted that the fibrous cellulose, as part of the propellant composition with the phase-stabilized ammonium nitrate, may assist or contribute to the phase stabilization of ammonium nitrate. Although not intending to be committed to any one particular theory, it is believed that the fibrous cellulose may absorb moisture, which can be useful during a temperature phase change associated with ammonium nitrate so that the overall volume of the composition does not increase or is not detrimentally impacted, at least in part to the presence of the fibrous cellulose.

The propellant composition also includes a material for enhancing or increasing the burning rate, as well as the ignition, of the propellant composition that is comprised substantially of PSAN. In that regard, such an enhancing material increases the burn rate exponent of the propellant composition, in comparison with the burn rate exponent of PSAN itself. Thus, there is increased burning rate and ignitability associated with the propellant composition due to the presence of such an enhancing material over, or in comparison with, the PSAN by itself. On the other hand, the enhancing material does not result in the propellant composition having a relatively high burn rate exponent which is indicative of unwanted instability of the device. In that regard, the enhancing material results in the propellant composition having a burn rate exponent of no greater than n=0.7.

In the preferred embodiment, this enhancing material includes fibrous cellulose. Fibrous cellulose is a commonly available component, such as that available from pulp board or wood pulp that is typically used in papermaking processes. The fibrous cellulose is comprised of a number of fibrous cellulose pieces or fibers. Each of the pieces has a length and width and the lengths of the fibrous cellulose pieces are at least five times greater than their widths. In that regard, the widths of the fibrous cellulose pieces are in the range of about 2.5 microns–250 microns and the lengths of the fibrous cellulose pieces are in the range of about 1000 microns–10,000 microns. The fibrous cellulose pieces are also different from cellulose material in non-fibrous form such as nitrocellulose, cellulose acetate and cellulose acetate butyrate. Consequently, fibrous cellulose or any fibrous cellulosic material is included in a group that is acceptable as a component of the propellant composition, while non-fibrous forms of cellulosic materials are excluded from the group of acceptable components.

The propellant composition also preferably includes hydroxypropylcellulose (HPC) as part of a binder system of the propellant composition, although other known or conventional binder products could be utilized. The HPC contributes to suspending the solid ingredients of the propellant composition in connection with providing the appropriate rheology for extrusion. The fibrous cellulose is also part of the binder system. The HPC also acts as a fuel in the propellant composition, as does the fibrous cellulose. The propellant composition can also include a stabilizer for use in preventing decomposition of the propellant composition. In one embodiment, methylnitroaniline (MNA) is utilized. A ph control material can also be incorporated as part of the propellant composition. In one embodiment, this material includes magnesium carbonate ($MgCO_3$) or its equivalent. A plasticizer material can be used to modify the properties of the HPC or other binder plastisol.

With respect to a summary of the components for an embodiment of the propellant composition, the following chart is provided:

| Component Identity | Amount by weight | Function(s) |
|---|---|---|
| Ammonium Nitrate | 75.65% ± 5% | Oxidizer |
| Potassium Nitrate | 9.35% ± 3% | Phase Stabilizer |
| Fibrous Cellulose | 9.00% ± 3% | Fuel and Re-Enforce |
| HPC | 5.00% ± 2% | Binder and fuel |
| MNA | 1.00% ± 0.75% | Stabilizer |
| $MgCO_3$ | 0.20% + .8% − .1% | ph control |

With regard to making the propellant, reference is made to the drawing FIGURE. Ammonium nitrate is integrated with a phase stabilizing component such as potassium nitrate, using a fusion (or precipitation) device 10 or at a fusion (or precipitation) station. This combination constitutes the phase-stabilized ammonium nitrate that is able to function in an inflator, even after undergoing a substantial number of arbitrary temperature cycles (at least 25) in the temperature range of −40° C. through +90° C. For example, we have discovered that many PSAN-based propellants should have each temperature cycle last at least a day, because days are required for equilibrium phase changes in ammonium nitrate.

The fused ammonium nitrate and potassium nitrate (PSAN) is supplied to a grinder unit 20 or machine that grinds or otherwise forms the PSAN into a suitable size for proper usage in further process steps in making the propellant. In that regard, the PSAN particles of the desired size are fed into a mixing vessel 30 where it is to be mixed or otherwise joined with the remaining components of the propellant composition. A fibrous cellulose having an associated liquid carrier is input to the mixing vessel 30. The liquid carrier usually includes an alcohol-based solvent to provide the fibrous cellulose with a desired constituency or viscosity. Also supplied to the mixing vessel 30 is the HPC, together with other components that have been identified, such as the MNA and the $MgCO_3$. Each of these is provided in the mixing vessel 30 in accordance with their desired amounts by weight. The mixing vessel 30 combines all of these components so that the resulting mixture or propellant composition is uniform, or essentially uniform, when output from the mixing vessel 30. The propellant composition is substantially uniform in that, for each selected cross-section of the uniform mixture, any 1000-micron portion of the selected cross-section has the same composition as any other 1000-micron portion of the selected cross-section.

The propellant composition from the mixing vessel is next applied to an extrusion machine 40, which extrudes or otherwise shapes the soft constituency of the propellant so that the propellant is output in a desired shape, for example, suitable for further processing to obtain a propellant that can be part of an inflator. A selected one of a number of different extrusion machines could be utilized, such as one that provides a continuous extruded output or, alternatively, a batch extrusion machine. After being extruded, the propellant is received by a dryer 50 that removes moisture, particularly the solvent, from the propellant. The propellant output by the dryer 50 has a common or conventional density. This density is typically less than 80% of theoretical density. That is, the propellant composition, particularly the fibrous cellulose, results in the propellant having some porosity after being dried in the dryer 50. Such porosity limits the density magnitude of the propellant composition, particularly in comparison with a theoretical density of 100%.

Significantly, the process of the present invention requires a further propellant shaping stage by which the propellant density is increased to at least 85% of theoretical density. In one embodiment, the dried propellant is provided to a roller mill or other comparable machine 60 that presses, flattens or otherwise reduces the thickness of the propellant input thereto. After increasing the density of propellant using the roller mill 60, the flattened or ribbon-like propellant structure can be cut using a cutting machine 70 into the desired sizes or lengths of propellant that would be provided in the inflator. The cutting machine 70 may include a severing device or element 74 that is automatically controlled to achieve the desired sizes as the ribbon-like propellant is fed into the cutting machine 70.

In one embodiment, the roller mill 60 includes first and second press elements or wheels 80, 90, respectively. The ribbon-like propellant is fed between the two press elements 80, 90. As the propellant moves through the press elements 80, 90, a force is applied to the propellant thereby flattening it and increasing its density. In conjunction with preparing propellant with the desired density, a prototype roller mill 60 was built. The extruded and dried propellant was manually fed into this prototype machine. The propellant was received between the first press wheel 80 and the second press wheel 90. The desired propellant density was obtained by controlling pneumatic pressure applied to the mounting for the second press wheel 90, although a design could be provided where the first press wheel 80, or both press wheels 80, 90, have a pressure applied thereto. The magnitude or strength of the press force is controlled by a pressure regulator. Additionally, the press wheels 80, 90 are geared together for optimum propellant through-put.

The thickness and concomitantly the resulting density of the propellant can be controlled to achieve a propellant having the predetermined resulting density. In that regard, depending on the thickness and associated density of the propellant, a propellant burning rate is achieved. Generally, as the thickness of the propellant is decreased, the burning rate increases. Consequently, the roller mill 60 can be utilized to output a propellant having a desired burning rate within a range of burning rates. Based on usual circumstances and desired propellant parameters, the propellant input to the roller mill 60 has a density in the range of about 55%–60% of theoretical density, and less than 80% of theoretical density. The propellant output from the roller mill 60 has a thickness in the range of about 0.4 mm–6 mm and a burning rate in the range of about 5 mm/sec–100 mm/sec at about 5000 psi and, more preferably, the thickness is in the range of about 0.6 mm–3 mm and with a burning rate in a rang of about 7.5 mm/sec–50 mm/sec at about 5000 psi.

The foregoing discussion of the invention has been presented for purposes of illustration and description. Further, the description is not intended to limit the invention to the form disclosed herein. Consequently, variations and modifications commensurate with above teachings, within the skill and knowledge of the relevant art, are within the scope of the present invention. The embodiments described hereinabove are further intended to explain the best mode of practicing the invention and to enable others skilled in the art to utilize the invention in such, or in other embodiments and with the various modifications required by their particular application or uses of the inventions. It is intended that the appended claims be construed to include alternative embodiments to the extent permitted by the prior art.

What is claimed is:

1. A method for making propellant for use in an inflator located in a vehicle, comprising:

providing phase-stabilized ammonium nitrate by integrating potassium nitrate with ammonium nitrate such that said ammonium nitrate and said potassium nitrate are fused together;

mixing said phase-stabilized ammonium nitrate with at least fibrous cellulose to form a mixture, wherein said fibrous cellulose is between 6% and 12% by weight of said mixture of said phase-stabilized ammonium nitrate and said at least fibrous cellulose;

forming a thin, continuous length of propellant having a first density from said mixture of said phase-stabilized ammonium nitrate and said at least fibrous cellulose; and working said thin, continuous length of propellant to provide said thin, continuous length of propellant with a second density greater than said first density.

2. A method, as claimed in claim 1, further including:

cutting said thin, continuous length of said propellant into a number of propellant pieces.

3. A method, as claimed in claim 1, wherein:

said second density is at least 85% of theoretical density.

4. A method, as claimed in claim 1, wherein:

said second density is a predetermined density related to a burning rate of said propellant.

5. A method, as claimed in claim 1, wherein:

said working step includes causing said propellant to have a thickness in a range of about 0.4 mm–6 mm and a burning rate in a range of about 5 mm/sec–100 mm/sec at about 5000 psi.

6. A method, as claimed in claim 1, wherein:

said propellant is a substantially uniform mixture in which, for each selected cross-section of said substantially uniform mixture, any 1,000-micron portion of said selected cross-section has the same composition as any other 1,000-micron portion of said selected cross-section.

7. A method, as claimed in claim 1, wherein:

said forming step includes extruding said mixture of said phase-stabilized ammonium nitrate and said at least fibrous cellulose.

8. A method, as claimed in claim 1, further including:

grinding said phase-stabilized ammonium nitrate before said mixing step.

9. A method, as claimed in claim 1, wherein:

said phase-stabilized ammonium nitrate further includes at least one of the following: potassium fluoride, magnesium carbonate, copper/nickel amine complexes, potassium dinitramide, ammonium polyphosphates and cesium nitrate.

10. A method, as claimed in claim 1, wherein:

said phase-stabilized ammonium nitrate includes a copper material.

11. A method, as claimed in claim 1, wherein:

said working step includes continuously flattening said propellant using a roller mill having at least a first press element that is in contact with said propellant.

12. A method, as claimed in claim 11, wherein:

said roller mill includes a second press element over which said propellant moves and said working step includes controlling said second density to a predetermined density by a force applied to one of said first and second press elements.

13. A method for making a propellant for use in an inflator located in a vehicle, comprising:

providing phase-stabilized ammonium nitrate by integrating potassium nitrate with ammonium nitrate such that said ammonium nitrate and said potassium nitrate are fused together;

forming a propellant having a first density that includes at least said phase-stabilized ammonium nitrate mixed with fibrous cellulose having amounts by weight as follows:

(a) ammonium nitrate 76.65%±5%;

(b) potassium nitrate 9.35%±3%;

(c) fibrous cellulose 9.00%±3%; and working said propellant to provide said propellant with a second density that is at least about 85% of theoretical density.

14. A method, as claimed in claim 13, wherein:

said first density is less than 80% of theoretical, density.

15. A method, as claimed in claim 13, wherein:

said working step includes flattening said propellant using a roller mill having at least a first press element.

16. A method, as claimed in claim 13, wherein:

said propellant has a burn rate exponent no greater than 0.7.

17. A method for making a propellant for use in an inflator located in a vehicle, comprising:

providing phase-stabilized ammonium nitrate by integrating potassium nitrate with ammonium nitrate such that said ammonium nitrate and said potassium nitrate are fused together;

forming a propellant having a first density that includes at least said phase-stabilized ammonium nitrate mixed with fibrous cellulose, said propellant being a substantially uniform mixture in which, for each selected cross-section of said substantially uniform mixture, any 1000-micron portion of said selected cross-section has the same composition as any other 1000-micron portion of said selected cross-section; and working said propellant to provide said propellant with a second density that is at least about 85% of theoretical density, with a thickness in a range of about 0.4 mm–6 mm and with a burning rate in a range of about 5 mm/sec–100 mm/sec at about 5000 psi.

18. A method, as claimed in claim 17, wherein:

said working step includes flattening said propellant using a roller mill having at least a first press element.

19. A method, as claimed in claim 17, wherein:

said propellant has a burn rate exponent no greater than 0.7.

20. A method, as claimed in claim 17, wherein:

said phase-stabilized ammonium nitrate further includes at least one of the following: potassium fluoride, magnesium carbonate, copper/nickel amine complexes, potassium dinitramide, ammonium polyphosphates and cesium nitrate.

21. A method, as claimed in claim 17, wherein:

said phase-stabilized ammonium nitrate includes a copper material.

* * * * *